US007032583B1

(12) United States Patent
Hall

(10) Patent No.: US 7,032,583 B1
(45) Date of Patent: Apr. 25, 2006

(54) BALL THROWING APPARATUS

(76) Inventor: Bobby Joe Hall, 17831 US Highway 43, Linden, AL (US) 36748

( * ) Notice: Subject to any disclaimer, the term of this patent is extended or adjusted under 35 U.S.C. 154(b) by 0 days.

(21) Appl. No.: 10/937,396

(22) Filed: Sep. 10, 2004

(51) Int. Cl.
*F41B 3/00* (2006.01)

(52) U.S. Cl. ..... 124/5

(58) Field of Classification Search ..... 124/4, 124/5, 41.1, 79
See application file for complete search history.

(56) References Cited

U.S. PATENT DOCUMENTS 1,535,029 A 4/1925 Murch
2,644,441 A * 7/1953 Simko ..... 124/5
3,428,036 A 2/1969 Parker
3,589,349 A 6/1971 Parker
4,872,688 A * 10/1989 Galvin ..... 473/509
5,427,084 A * 6/1995 Arnold et al. ..... 124/5
5,515,835 A * 5/1996 Minneman et al. ..... 124/5
5,556,319 A * 9/1996 Watkins ..... 446/475
D424,640 S 5/2000 Oblack
6,076,829 A 6/2000 Oblack

* cited by examiner

*Primary Examiner*—John A. Ricci
(74) *Attorney, Agent, or Firm*—George L. Williamson

(57) ABSTRACT

The present invention discloses a device for throwing a ball. The pouch is disposed on the end of an arm so that the ball contained in the pouch can be thrown in an overhand or underhand manner by the user. The pouch is attached to the arm on one end and a rubber band-like member is disposed in the pouch on the other open end, which rubber band holds the ball inside the pouch. As the arm and pouch are thrown by a user, the ball gains enough inertia through the arc of the throwing motion that the ball stretches the rubber band and passes between the rubber band and the pouch and, therefore, exits from the open end of the pouch.

13 Claims, 3 Drawing Sheets

BALL THROWING APPARATUS

BACKGROUND OF THE INVENTION

1. Field of the Invention

The present invention relates generally to athletic equipment and, more specifically, to a device for throwing a ball.

2. Description of the Prior Art

Devices for throwing balls have been described in the prior art; however, none of the prior art devices disclose the unique features of the present invention.

In U.S. Pat. No. 1,535,029, dated Apr. 21, 1925, Murch disclosed an object of the invention which is to provide a toy of this kind which is adapted to grip the ball with sufficient resiliency to hold it under normal conditions but which will release the ball when a throwing action is imparted thereto so that the ball can be projected with great force and accuracy.

In U.S. Pat. No. 3,428,036, dated Feb. 18, 1969, Parker disclosed an adjustable apparatus which resiliently but releasably holds a ball or the like in a side opening flange assembly mounted on the end of a resilient member mounted on the end of an operating handle. The resilient member facilitates the ball throwing by flexing backward at the start of the throwing motion and then flexing forward as the end of the throwing motion is approached to provide an improved throwing action.

In U.S. Pat. No. 3,589,349, dated Jun. 29, 1971, Parker disclosed an improved ball-gripping and throwing apparatus wherein the ball-holding member is non-adjustably and immovably fixed to the spring handle by an integral extension of the ball-gripping arm elements, the ball-holding member otherwise including a pair of spaced flexible gripping leaves and a pair of pressure arms adjustable forced against the outside of the gripping leaves to vary the pressure with which they engage and hold a ball positioned therebetween.

In U.S. Pat. No. 6,076,829, dated Jun. 20, 2000, Oblack disclosed objects which are met by a ball throwing apparatus including an elongated shaft with a half-spherical structure attached to or formed at its distal end designed to easily engage and pick up a ball for throwing without having to touch the ball with your hand or fingers. Also disclosed herein is a method of playing the game of fetch with an animal using the apparatus.

In U.S. Pat. No. Des, 424,640, dated May 9, 2000, Oblack disclosed the ornamental design for a ball throwing apparatus, as shown and described.

While these ball throwing devices may be suitable for the purposes for which they were designed, they would not be as suitable for the purposes of the present invention, as hereinafter described.

SUMMARY OF THE PRESENT INVENTION

The present invention discloses a device for throwing a ball wherein the velocity of the thrown ball can be varied. The pouch is disposed on the end of an arm so that the ball contained in the pouch can be thrown in an overhand or underhand manner by the user. The pouch is attached to the arm on one end and a rubber band-like member is disposed in the pouch on the other open end, which rubber band holds the ball inside the pouch. As the arm and pouch are thrown by a user, the ball gains enough inertia through the arc of the throwing motion that the ball stretches the rubber band and passes between the rubber band and the pouch and, therefore, exits from the open end of the pouch. The tension on the rubber band can be varied so as to vary the velocity of the thrown ball.

An object of the present invention is to provide an arm for throwing a ball. A further object of the present invention is to provide a ball-throwing device which can be easily used. A further object of the present invention is to provide a ball-throwing device which can be easily and inexpensively manufactured.

The foregoing and other objects and advantages will appear from the description to follow. In the description reference is made to the accompanying drawings, which form a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWINGS

In order that the invention may be more fully understood, it will now be described, by way of example, with reference to the accompanying drawings in which.

LIST OF REFERENCE NUMERALS

Figure 1:
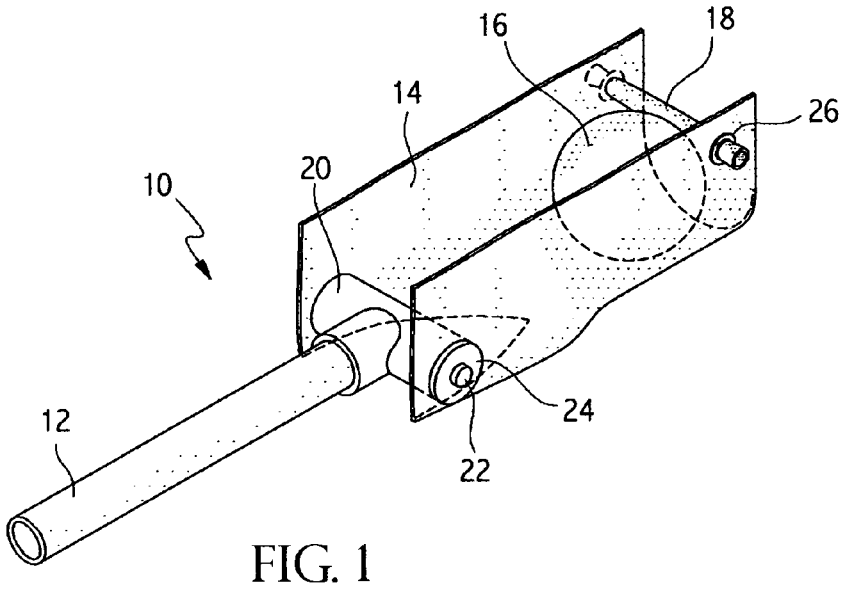
FIG. 1 is a perspective view of the present invention.

With regard to reference numerals used, the following numbering is used throughout the drawings.

| | |
|---|---|
| 10 | present invention |
| 12 | arm |
| 14 | pouch |
| 16 | ball |
| 18 | elastic member |
| 20 | T-member |
| 22 | bolt |
| 24 | washer |
| 26 | washer |
| 28 | nut |
| 30 | user |

DETAILED DESCRIPTION OF THE PREFERRED EMBODIMENT

Turning now descriptively to the drawings, in which similar reference characters denote similar elements throughout the several views wherein FIGS. 1 through 7 illustrate the present invention wherein a device for throwing a ball is disclosed.

Turning to FIG. 1, shown therein is the present invention 10 having an arm 12 with a pouch 14 disposed on the end of the arm. The arm 12 is to be held by the user in order to throw the ball 16. The pouch 14 is attached to the arm 12 on one end and has a rubber or latex tubing or rubber-band like elastic member 18 disposed on the other end of the pouch holding the ball 16 within the pouch. The arm 12 has a T-shaped member 20 disposed on one end and the pouch 14 is connected to the T-member using a bolt 22, nut 28 and a washer 24. The latex member 18 has a washer 26 disposed on opposite ends so as to provide a frictional member for holding the latex member to the pouch 14 which allows the tension on member 18 to be varied by pulling one end of member 18 through a washer 26, which washer 26 has a smaller diameter than member 18. The pouch 14 can be made of fabric, flaccid material, nylon or HERCULITE.

Figure 2:
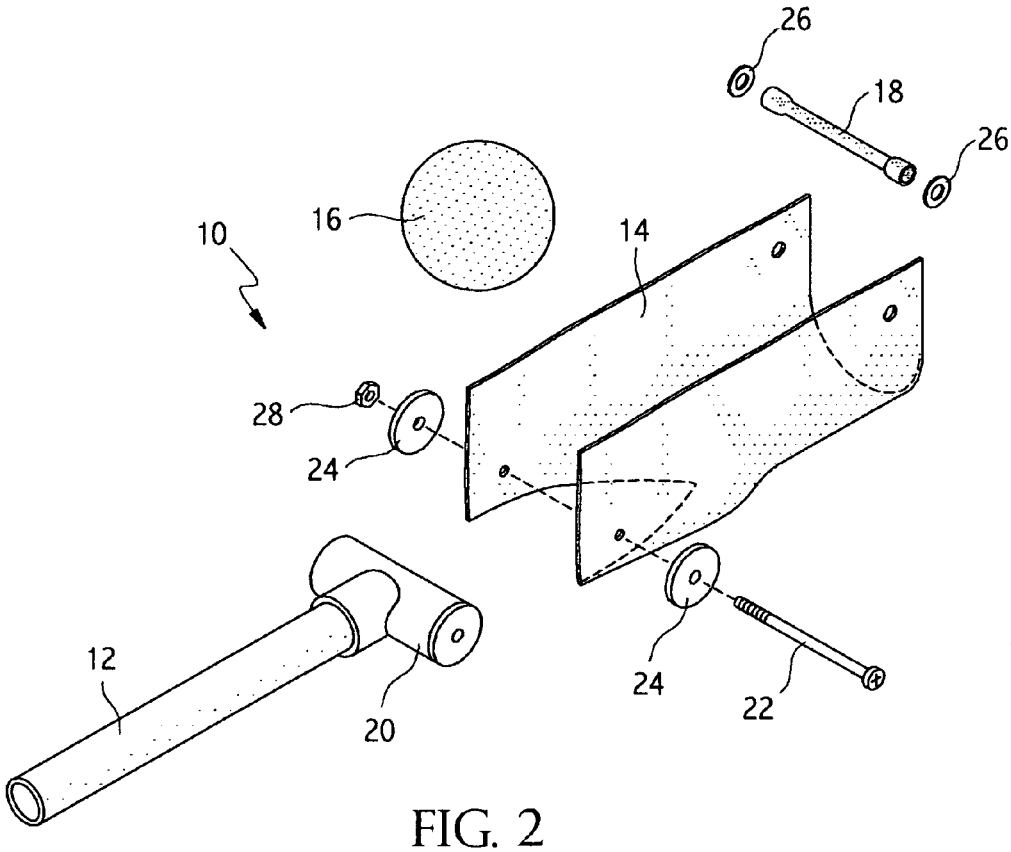
FIG. 2 is an exploded view of the present invention.
Figure 3:
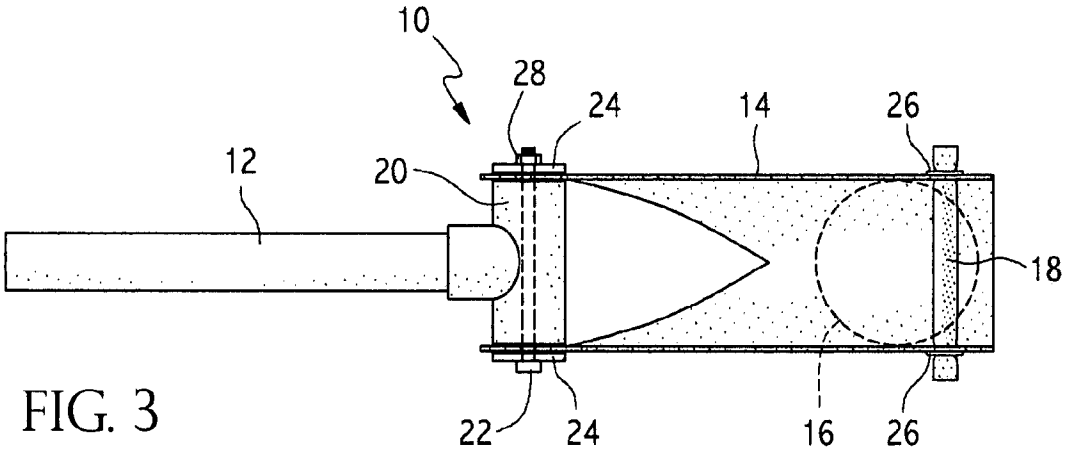
FIG. 3 is a plan view of the present invention.
Figure 5:
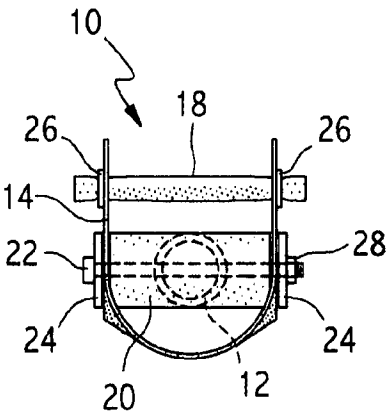
FIG. 5 is a cross section view of the present invention.
Figure 4:
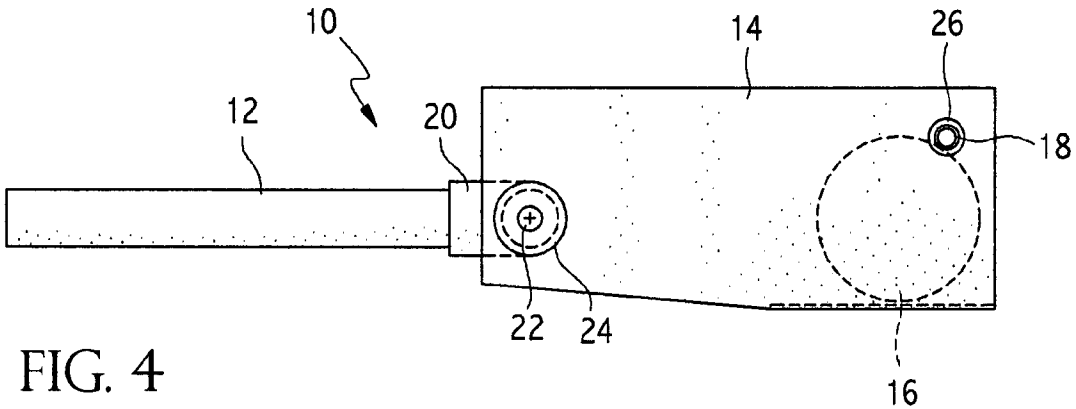
FIG. 4 is a side view of the present invention.
Figure 6:
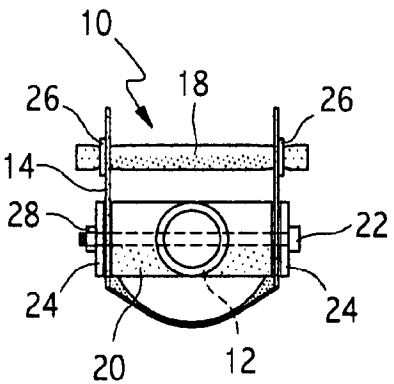
FIG. 6 is a cross section view of the present invention.

Turning to FIG. 2, shown therein is the arm 12, pouch 14, ball 16, latex member 18, T-member 20, bolt 22, washers 24 and washers 26. A nut 28 is also shown for attaching to the opposite end of bolt 22.

Turning to FIGS. 3, 4, 5 and 6, shown therein are the components of the present invention 10 in various views.

Figure 7:
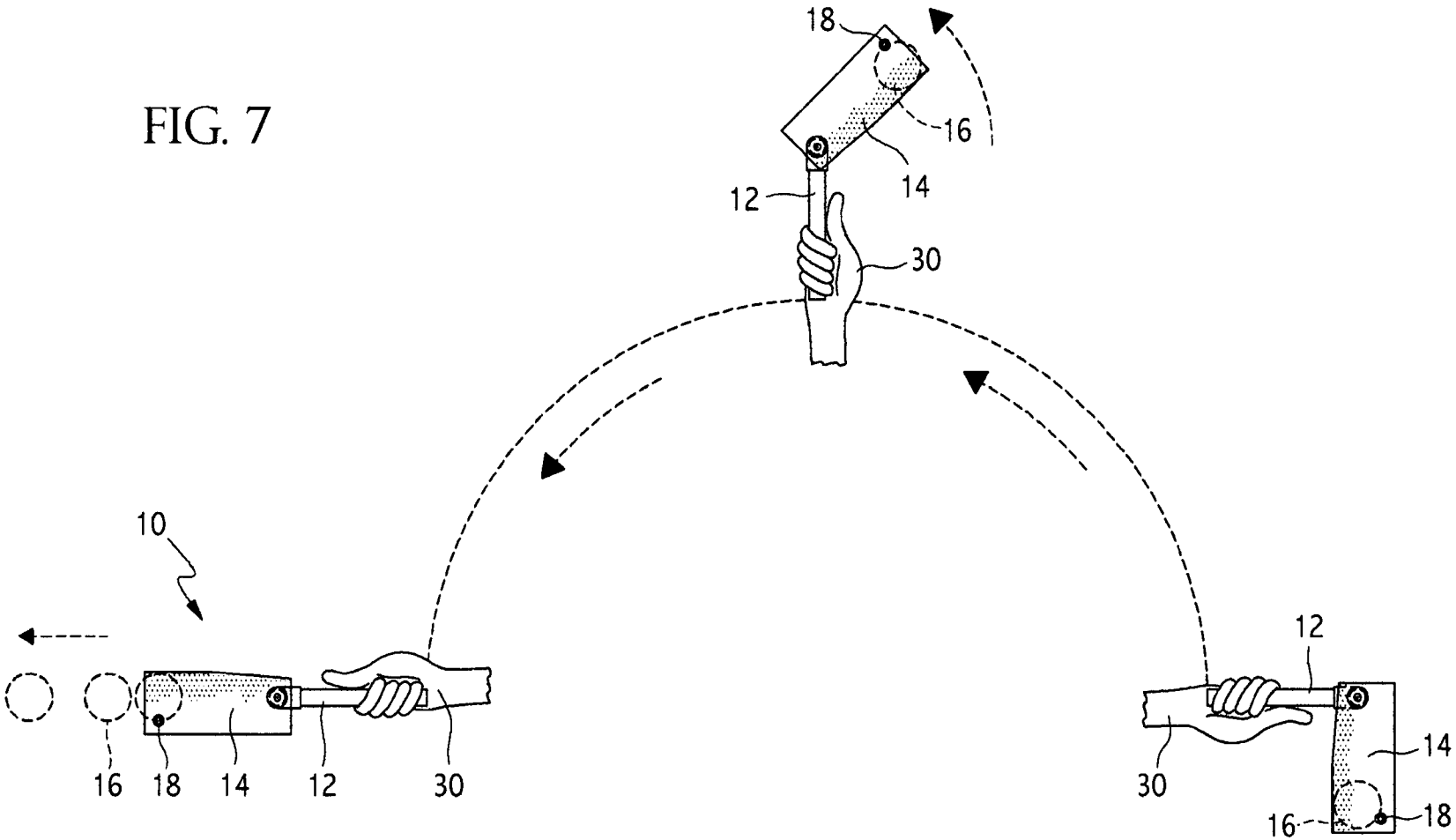
FIG. 7 is a side view of the present invention in use.

Turning to FIG. 7, shown therein is the user 30 holding the arm 12 and the user's arm and showing the ball 16 throwing motion of the present invention 10. In the first position the ball 16 is held within the pouch 14 by elastic member 18. In the overhead or second position, the inertia of the throwing motion causes the ball 16 to begin to pass between the end of the pouch 14 and the elastic member 18 by stretching or deforming the elastic member 18. In the third position, the ball 16 is shown having been released from the pouch 14 and having passed out of the open end of the pouch by passing between elastic member 18 and the open end of the pouch 14.

I claim:

1. An apparatus for throwing a ball, comprising;

a) an arm having first and second opposing ends;

b) a pouch having first and second opposing ends, wherein said end is connected to said first end of said arm, wherein said second end is open so that the ball can be placed in the pouch and then can exit from the pouch through said open end as said second end of said arm is held by a user and the ball thrown by the apparatus;

c) a tensioning member being disposed on said open end of said pouch so that the ball can be frictionally held in said pouch and then the ball can exit from the pouch after the ball has enough inertia to move past said tension member; and, d) wherein said pouch is made of fabric.

2. The apparatus of claim 1, wherein said pouch is made of flaccid material.

3. The apparatus of claim 2, wherein said pouch is made of nylon fabric.

4. The apparatus of claim 3, wherein said tensioning member comprises an elastic band.

5. The apparatus of claim 4, wherein said tensioning member comprises a latex rubber band.

6. The apparatus of claim 5, wherein said tensioning member is adjustable so that the friction on the ball can be varied so that the velocity of the thrown ball can be varied.

7. The apparatus of claim 1, wherein said first end of said pouch is rotatably connected to said first end of said arm.

8. An apparatus for throwing a ball, comprising:

a) an arm having first and second opposing ends;

b) a "T" shaped end cap being disposed on said first end of said arm, said " " shaped end cap having first and second opposing ends;

c) a pouch having first and second opposing ends and first and second opposing sides, wherein said first end is connected to said first end of said arm, wherein said second end is open so that the ball can be placed in the pouch and then can exit from the pouch through said open end as said second end of said arm is held by a user and the ball thrown by the apparatus, wherein said first side is connected to said first end of said "T" shaped end cap and said second side is connected to said second end of said "T" shaped end cap; and, d) a tensioning member being disposed on said open end of said pouch so that the ball can be frictionally held in said pouch and then the ball can exit from the pouch after the ball has enough inertia to move past said tensioning member.

9. The apparatus of claim 8, wherein said tensioning member extends from said first side of said pouch to said second side of said pouch.

10. The apparatus of claim 9, wherein said pouch is made of nylon fabric.

11. The apparatus of claim 10, wherein said tensioning member is adjustable so that the friction on the ball can be varied so that the velocity of the thrown ball can be varied.

12. The apparatus of claim 11, wherein said tensioning member is adjusted by placing a washer on said tensioning member on said first and second sides of said pouch, wherein said washer has a smaller diameter than said tensioning member, so that said tensioning member can be adjusted by pulling one of its ends through one of said washers to permit the tension on said tension member to be varied.

13. The apparatus of claim 8, wherein said first end of said pouch is rotatably connected to said first end of said arm.

* * * * *